US008147473B2

(12) United States Patent
Butsch et al.

(10) Patent No.: US 8,147,473 B2
(45) Date of Patent: Apr. 3, 2012

(54) FOLDED FIBROUS STRUCTURES

(75) Inventors: William Joseph Butsch, Harrison, OH (US); Kevin Benson McNeil, Loveland, OH (US); Lois Jean Forde-Kohler, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1556 days.

(21) Appl. No.: 11/059,977

(22) Filed: Feb. 17, 2005

(65) Prior Publication Data

US 2006/0184148 A1 Aug. 17, 2006

(51) Int. Cl.

| | |
|---|---|
| ***A61F 13/15*** | (2006.01) |
| ***B65D 81/24*** | (2006.01) |
| ***B65D 85/00*** | (2006.01) |

(52) U.S. Cl. ..... 604/385.201; 604/385.01; 604/385.11; 206/210; 206/204; 206/395; 206/396; 206/397

(58) Field of Classification Search ..... 206/210, 206/823, 204, 459.5, 395–397; 604/385.01, 604/385.201, 385.11

See application file for complete search history.

(56) References Cited

U.S. PATENT DOCUMENTS

| | | | |
|---|---|---|---|
| 1,980,059 | A | 11/1934 | Housen |
| 2,033,621 | A | 3/1936 | Freedman |
| 3,207,360 | A | 9/1965 | Scott |
| 3,326,365 | A | 6/1967 | Neureither et al. |
| 3,853,279 | A | 12/1974 | Gerstein |
| 3,918,661 | A | 11/1975 | Kishi et al. |
| 4,163,548 | A | 8/1979 | Nystrand |
| 4,190,241 | A | 2/1980 | Krueger |
| 4,535,912 | A | 8/1985 | Bonk |
| 4,582,743 | A | 4/1986 | Bahring |
| 4,859,518 | A | 8/1989 | Schutz |
| 5,011,017 | A | 4/1991 | Giesen |
| 5,023,126 | A | 6/1991 | Stevens et al. |
| 5,088,975 | A | 2/1992 | Ghilardi |
| 5,115,568 | A | 5/1992 | Aida |
| 5,116,043 | A | 5/1992 | Jermann et al. |
| 5,219,092 | A | 6/1993 | Morand |
| 5,242,364 | A | 9/1993 | Lehmann |
| 5,520,604 | A | 5/1996 | Reist |
| 5,565,258 | A | 10/1996 | McConnell et al. |
| 5,609,269 | A | 3/1997 | Behnke et al. |
| 6,045,002 | A | 4/2000 | Wierschke |
| 6,168,848 | B1 | 1/2001 | Heath |
| 6,257,410 | B1 | 7/2001 | Ulmann et al. |
| D471,395 | S | 3/2003 | Wong |
| D472,093 | S | 3/2003 | Wong |
| D482,922 | S | 12/2003 | Wong |
| D486,026 | S | 2/2004 | Wong |
| 6,719,680 | B2 | 4/2004 | Hosoya et al. |
| 2004/0048727 | A1 | 3/2004 | Roozrokh |
| 2004/0115394 | A1 | 6/2004 | Lange et al. |

FOREIGN PATENT DOCUMENTS

| | | | |
|---|---|---|---|
| EP | 0 182 713 | A1 | 5/1986 |
| EP | 0 857 453 | A1 | 8/1998 |
| EP | 0 978 247 | A1 | 2/2000 |
| EP | 0 916 326 | B1 | 1/2002 |
| EP | 1 277 687 | A2 | 1/2003 |
| WO | WO 98/37794 | | 9/1998 |
| WO | WO 99/58039 | | 11/1999 |
| WO | WO 01/62641 | A1 | 8/2001 |
| WO | WO 02/059026 | A1 | 8/2002 |
| WO | WO 03/004257 | A1 | 1/2003 |
| WO | WO 2005/034701 | A1 | 4/2005 |

*Primary Examiner* — Jacqueline F. Stephens

(74) *Attorney, Agent, or Firm* — C. Brant Cook; Christian M. Best

(57) ABSTRACT

Folded fibrous structures, more particularly, folded sanitary tissue products, especially in rolled form, are provided.

20 Claims, 5 Drawing Sheets

FOLDED FIBROUS STRUCTURES

FIELD OF THE INVENTION

The present invention relates to folded fibrous structures, more particularly, folded fibrous structure implements and/or folded sanitary tissue product implements, especially in rolled form.

BACKGROUND OF THE INVENTION

Consumers of fibrous structures, especially sanitary tissue products such as toilet paper, dispense several sheets of the fibrous structure and then proceed to fold the sheets onto themselves to form a wiping implement and/or crumple the sheets into a ball to form a wiping implement prior to using such implement for cleaning themselves after post-bowel and/or post-urinary actions.

Even though C-, V- and/or Z-folded fibrous structures are well known in the art especially for individual implements such as facial tissues and/or napkins, rolled products, especially toilet tissue, comprising consumer usable, preformed, folded fibrous structure implements are not well known.

The known folded fibrous structures in roll form exhibit problems with aesthetics, handling by users, and/or failure to appreciate the advantages of a cross machine direction differential intensive property values of the fibrous structure, especially in a rolled form.

Accordingly, there is a need for a folded fibrous structure, especially in rolled form, that exhibits aesthetics pleasing to the user, functional benefits resulting from the folds, and cross machine direction differential intensive property values, especially in a rolled form.

SUMMARY OF THE INVENTION

The present invention fulfills the needs identified above by providing a rolled folded fibrous structure and/or sanitary tissue product, especially toilet tissue, comprising such a folded fibrous structure.

In one example of the present invention, a convolutely wound rolled sanitary tissue product comprising a consumer usable, preformed, folded fibrous structure implement capable of being dispensed from the rolled sanitary tissue product, wherein the consumer usable, preformed, folded fibrous structure implement comprises a first edge of the fibrous structure, a second edge of the fibrous structure and a body of the fibrous structure present between the first and second edges, wherein the first edge via a first flap of the fibrous structure present between the first edge and the body overlies a first surface of the body, is provided.

In another example of the present invention, a convolutely wound rolled sanitary tissue product comprising a consumer usable, preformed, folded fibrous structure implement capable of being dispensed from the rolled sanitary tissue product, wherein the consumer usable, preformed, folded fibrous structure implement exhibits a value of a fibrous structure property that varies along the entire cross machine direction of the fibrous structure implement, is provided.

In yet another example of the present invention, a convolutely wound rolled sanitary tissue product comprising a consumer usable, preformed, folded fibrous structure implement capable of being dispensed from the rolled sanitary tissue product, wherein the consumer usable, preformed, folded fibrous structure implement exhibits a design element, is provided. In one example, the design element is formed by the fibrous structure.

In even another example of the present invention, a convolutely wound rolled sanitary tissue product comprising a consumer usable, preformed, folded fibrous structure implement capable of being dispensed from the rolled sanitary tissue product, wherein the consumer usable, preformed, folded fibrous structure implement comprises a non-linear edge, is provided.

Accordingly, there is a need for folded fibrous structures, especially folded fibrous structures in roll form.

DETAILED DESCRIPTION OF THE INVENTION

Definitions

Figure 1A:
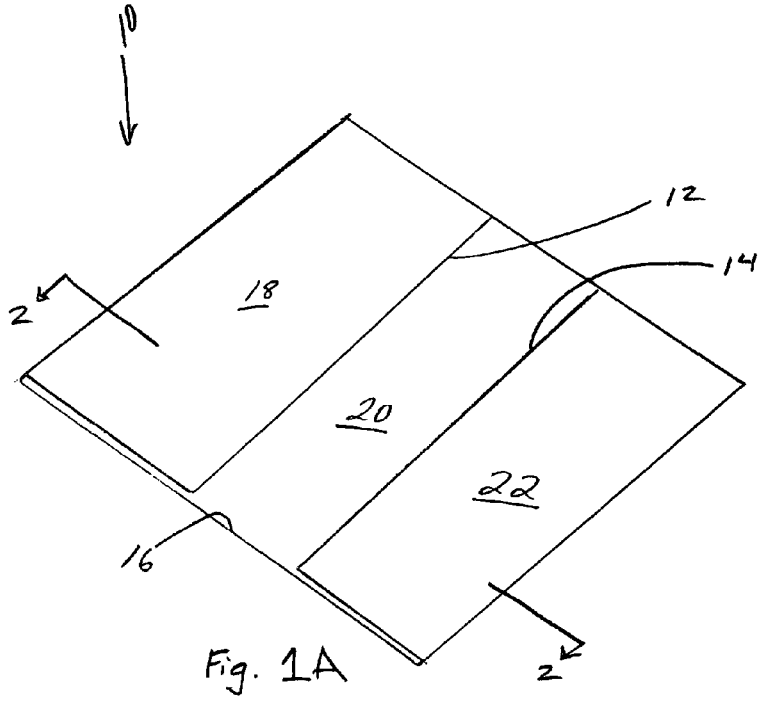
FIG. 1A is a perspective representation of a consumer usable, preformed, folded fibrous structure implement according to the present invention.

"Fibrous structure implement" as used herein means a fibrous structure having the dimensions that are suitable for use by a consumer for its intended purpose. For example, a fibrous structure implement may have a cross machine direction width of at least about 7 cm and/or at least about 9 cm and/or at least about 10 cm and/or at least about 11 cm to about 20 cm and/or to about 18 cm and/or to about 16 cm and/or to about 14 cm. For example, a fibrous structure implement may have a machine direction length of at least about 7 cm and/or at least about 10 cm and/or at least about 15 cm and/or at least about 20 cm and/or at least about 30 cm to about 100 cm and/or to about 80 cm and/or to about 60 cm.

In one example, a fibrous structure implement may comprise lines of weakness, such as in the cross machined direction such that different sizes of fibrous structure implements may be dispensed from a roll of fibrous structure implements.

"Preformed, folded fibrous structure implement" as used herein means a fibrous structure implement that exists in a folded form prior to use by a consumer. For example, the fibrous structure implement is present in a folded form, especially on a roll, at the time of purchase by a consumer.

"Consumer usable, preformed, folded fibrous structure implement" as used herein means that the preformed, folded fibrous structure implement is in a form acceptable for use by a consumer. In other words, a consumer would not need to fold and/or crumble the fibrous structure into an implement prior to use.

"Fibrous structure" as used herein means a structure that comprises one or more fibers. Nonlimiting examples of processes for making fibrous structures include known wet-laid papermaking processes and air-laid papermaking processes. Such processes typically include steps of preparing a fiber composition, oftentimes referred to as a fiber slurry in wet-laid processes, either wet or dry, and then depositing a plurality of fibers onto a forming wire or belt such that an embryonic fibrous structure is formed, drying and/or bonding the fibers together such that a fibrous structure is formed, and/or further processing the fibrous structure such that a finished fibrous structure is formed. For example, in typical papermaking processes, the finished fibrous structure is the fibrous structure that is wound on the reel at the end of papermaking, but before converting thereof into a sanitary tissue product.

Nonlimiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

The fibrous structures and/or sanitary tissue products of the present invention may exhibit a basis weight of between about 10 g/m$^2$ to about 120 g/m$^2$ and/or from about 14 g/m$^2$ to about 80 g/m$^2$ and/or from about 20 g/m$^2$ to about 60 g/m$^2$.

The fibrous structures and/or sanitary tissue products of the present invention may exhibit a total dry tensile strength of greater than about 59 g/cm (150 g/in) and/or from about 78 g/cm (200 g/in) to about 394 g/cm (1000 g/in) and/or from about 98 g/cm (250 g/in) to about 335 g/cm (850 g/in).

The fibrous structure and/or sanitary tissue products of the present invention may exhibit a density of less than about 0.60 g/cm$^3$ and/or less than about 0.30 g/cm$^3$ and/or less than about 0.20 g/cm$^3$ and/or less than about 0.10 g/cm$^3$ and/or less than about 0.07 g/cm$^3$ and/or less than about 0.05 g/cm$^3$ and/or from about 0.01 g/cm$^3$ to about 0.20 g/cm$^3$ and/or from about 0.02 g/cm$^3$ to about 0.10 g/cm$^3$.

In one example, the fibrous structure is in the form of a rolled product. For example, the fibrous structure is convolutely wound about a core or a void area where a core would be present, if one was present.

The fibrous structure comprises at least one consumer usable, preformed, folded fibrous structure.

In one example, the finished fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The finished fibrous structure may exhibit regions of higher density compared to other regions within the finished fibrous structure. In other words, the finished fibrous structure may comprise a differential density fibrous structure.

The finished fibrous structure may be creped or uncreped and/or foreshortened or not.

The finished fibrous structure may be a through-air-dried fibrous structure, a wet-pressed fibrous structure and/or a conventionally dried fibrous structure.

"Fiber" as used herein means an elongate particulate having an apparent length greatly exceeding its apparent diameter, i.e. a length to diameter ratio of at least about 10. A fiber can be a solid additive. Fibers having a non-circular cross-section are common; the "diameter" in this case may be considered to be the diameter of a circle having cross-sectional area equal to the cross-sectional area of the fiber. More specifically, as used herein, "fiber" refers to papermaking fibers. The present invention contemplates the use of a variety of papermaking fibers, such as, for example, natural fibers or synthetic fibers, or any other suitable fibers, and any combination thereof.

Natural papermaking fibers useful in the present invention include animal fibers, mineral fibers, plant fibers and mixtures thereof. Animal fibers may, for example, be selected from the group consisting of: wool, silk and mixtures thereof. Plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Nonlimiting examples of short fibers include fibers derived from a fiber source selected from the group consisting of Acacia, Eucalyptus, Maple, Oak, Aspen, Birch, Cottonwood, Alder, Ash, Cherry, Elm, Hickory, Poplar, Gum, Walnut, Locust, Sycamore, Beech, Catalpa, Sassafras, Gmelina, Albizia, Anthocephalus, and Magnolia. Nonlimiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); and mixtures thereof.

"Sanitary tissue product" comprises one or more finished fibrous structures, converted or not, that is useful as a wiping implement for post-urinary and post-bowel movement cleaning (toilet tissue), for otorhinolaryngological discharges (facial tissue), and multi-functional absorbent and cleaning uses (absorbent towels).

"Basis Weight" as used herein is the weight per unit area of a sample reported in lbs/3000 $ft^2$ or $g/m^2$. Basis weight is measured by preparing one or more samples of a certain area ($m^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples ($m^2$) is measured. The basis weight ($g/m^2$) is calculated by dividing the average weight (g) by the average area of the samples ($m^2$).

"Caliper" as used herein means the macroscopic thickness of a sample. Caliper of a sample of fibrous structure according to the present invention is determined by cutting a sample of the fibrous structure such that it is larger in size than a load foot loading surface where the load foot loading surface has a circular surface area of about 3.14 $in^2$ (20.3 $cm^2$). The sample is confined between a horizontal flat surface and the load foot loading surface. The load foot loading surface applies a confining pressure to the sample of 15.5 $g/cm^2$ (about 0.21 psi). The caliper is the resulting gap between the flat surface and the load foot loading surface. Such measurements can be obtained on a VIR Electronic Thickness Tester Model II available from Thwing-Albert Instrument Company, Philadelphia, Pa. The caliper measurement is repeated and recorded at least five (5) times so that an average caliper can be calculated. The result is reported in millimeters.

"Density" or "Apparent density" as used herein means the mass per unit volume of a material. For fibrous structures, the density or apparent density can be calculated by dividing the basis weight of a fibrous structure sample by the caliper of the fibrous structure sample with appropriate conversions incorporated therein. Density and/or apparent density used herein has the units $g/cm^3$.

"Machine Direction" or "MD" as used herein means the direction parallel to the flow of the fibrous structure through the papermaking machine and/or product manufacturing equipment.

"Cross Machine Direction" or "CD" as used herein means the direction perpendicular to the machine direction in the same plane of the fibrous structure and/or sanitary tissue product comprising the fibrous structure.

"Ply" or "Plies" as used herein means an individual finished fibrous structure optionally to be disposed in a substantially contiguous, face-to-face relationship with other plies, forming a multiple ply finished fibrous structure product and/or sanitary tissue product. It is also contemplated that a single fibrous structure can effectively form two "plies" or multiple "plies", for example, by being folded on itself.

All percentages and ratios are calculated by weight unless otherwise indicated. All percentages and ratios are calculated based on the total composition unless otherwise indicated.

Unless otherwise noted, all component or composition levels are in reference to the active level of that component or composition, and are exclusive of impurities, for example, residual solvents or by-products, which may be present in commercially available sources.

Consumer Usable, Preformed, Folded Fibrous Structure Implement

A sanitary tissue product of the present invention comprises a consumer usable, preformed, folded fibrous structure implement. The sanitary tissue product may be in the form of a rolled sanitary tissue product. The rolled sanitary tissue product may comprise a plurality of consumer usable, preformed, folded fibrous structure implements.

As shown in FIG. 1A, a consumer usable, preformed, folded fibrous structure implement 10 comprises a first edge of the fibrous structure 12, a second edge of the fibrous structure 14 and a body of the fibrous structure 16 present between the first edge 12 and the second edge 14. The first edge 12 via a first flap of the fibrous structure 18 present between the first edge 12 and the body 16 may overlie a first surface 20 of the body 16. The first flap 18 may contact the first surface 20 of the body 16.

The second edge 14 via a second flap of the fibrous structure 22 present between the second edge 14 and the body 16 may overlie the first surface 20 of the body 16. The second flap 22 may contact the first surface 20 of the body 16.

The first flap 18 and/or second flap 22 may overlie less than about 100% and/or less than about 95% and/or less than about 90% and/or less than about 85% and/or less than about 80% of the surface area of the first surface 20 of the body 16.

The first edge 12 and/or the second edge 14 may define a pattern (design element).

In one example, the pattern (design element) may comprise a shape. The shape may be selected from the group consisting of: hearts, circles, triangles, squares, rectangles, trapezoids and mixtures thereof.

In another example, the pattern (design element) may comprise an element selected from the group consisting of: animals, plants, flowers and mixtures thereof.

The first edge 12 and second edge 14 may be complementary.

The first edge 12 and second edge 14 may be mismatched.

Figure 1B:
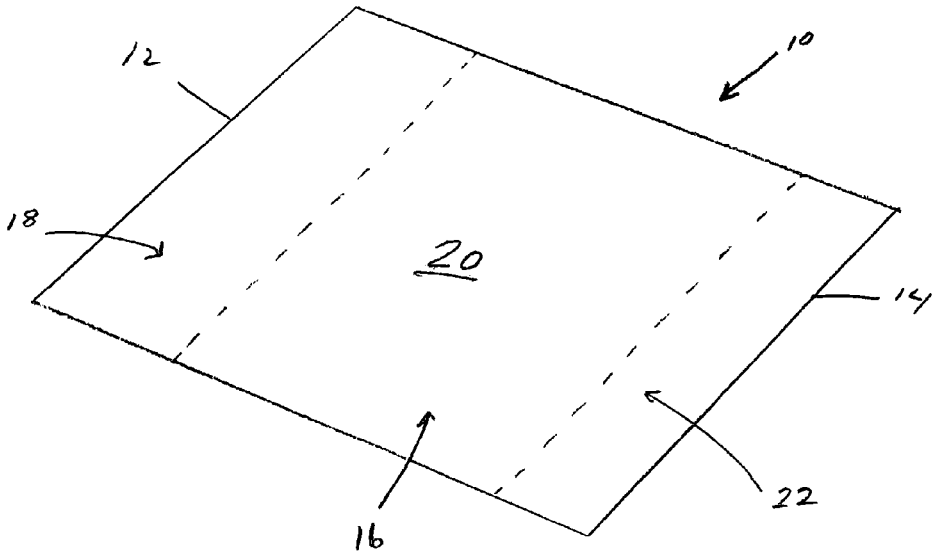
FIG. 1B is a perspective representation of the implement of FIG. 1 in its unfolded state.

FIG. 1B schematically illustrates the consumer usable, preformed, folded fibrous structure implement 10 of FIG. 1A in its unfolded form 10'. The dashed lines on the body 16 of the fibrous structure represent the fold lines for the first and second flaps 18, 22.

Figure 2:
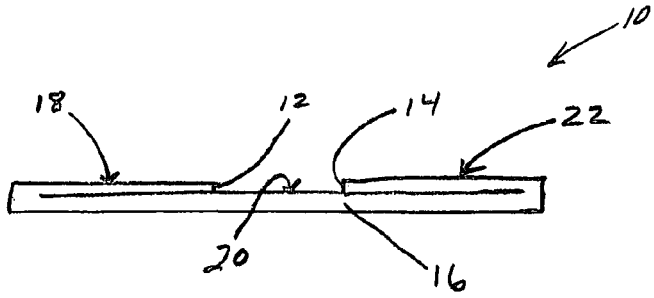
FIG. 2 is a cross-sectional view of the implement of FIG. 1 taken along line 2-2.

FIG. 2 is a cross-sectional view of the consumer usable, preformed, folded fibrous structure implement 10 of FIG. 1A. As shown in FIG. 2, the consumer usable, preformed, folded fibrous structure implement comprises effectively two portions that are "multi-ply" and one portion that is "single-ply."

In one example, the "multi-ply" portions of the folded fibrous structure implement exhibits a caliper of from about 75% and/or about 85% and/or about 95% to about 125% to about 115% and/or to about 105% of the caliper of the "single-ply" portion.

In one example, the caliper in the cross-machine direction of the folded fibrous structure implement varies across the entire cross-machine direction. For example, the caliper in the cross-machine direction of the folded fibrous structure implement is controlled to vary along the entire cross-machine direction by less than about 2 times and/or less than about 1.5 times and/or less than about 1.25 times and/or less than about 1.15 times and/or less than about 1.05 times the least caliper of the folded fibrous structure implement along the entire cross-machine direction. By controlling the differential caliper across the cross-machine direction of the folded fibrous structure implement, the folded fibrous structure implement may be wound into a roll that exhibits an effective caliper that varies across the entire cross-machine direction of the rolled folded fibrous structure implement by less than about 2 times and/or less than about 1.5 times and/or less than about 1.25 times and/or less than about 1.15 times and/or less than about 1.05 times the least caliper of the folded fibrous structure implement along the entire cross-machine direction.

Nonlimiting examples of processes useful in controlling the caliper of the folded fibrous structure implement in the cross-machine direction include imparting texture to portions of the fibrous structure such as by embossing, calendaring portions of the fibrous structure and/or adjusting the basis weight of portions of the fibrous structure.

Figure 3:
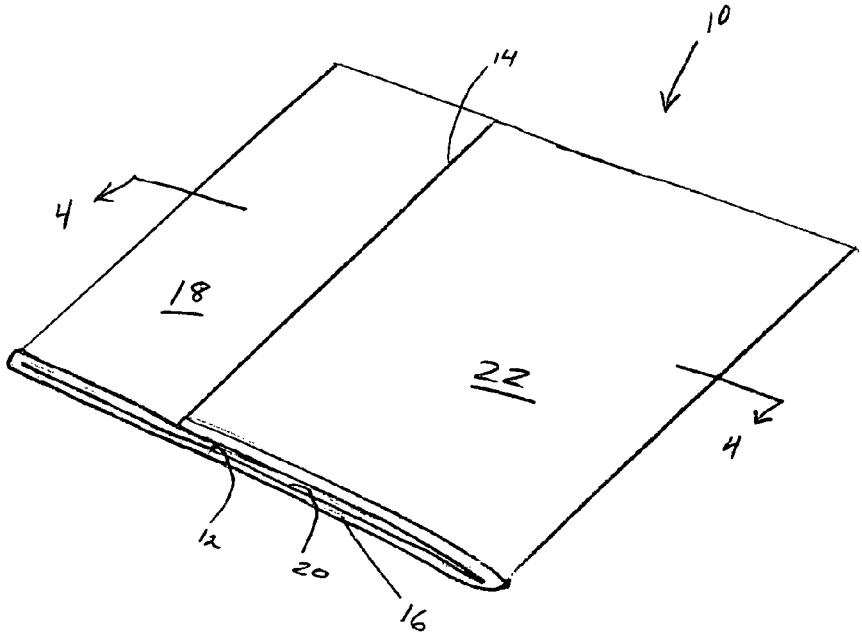
FIG. 3 is a perspective representation of another consumer usable, preformed, folded fibrous structure implement according to the present invention.

As shown in FIG. 3, the second edge 14 overlies the first flap 18. The folded fibrous structure of FIG. 3 effectively comprises a "three-ply" portion, in this case, generally in the center of the folded fibrous structure implement and two "two-ply" portions. The concept of having more of the fibrous structure implement where a consumer needs it; namely, near the center of the fibrous structure implement, may be desirable to consumers.

As shown in FIG. 3, the second flap 22 may overlie less than about 100% and/or less than about 90% and/or less than about 75% and/or less than about 50% and/or less than about 30% and/or less than about 15% of the surface area of the first flap 18.

Figure 4:
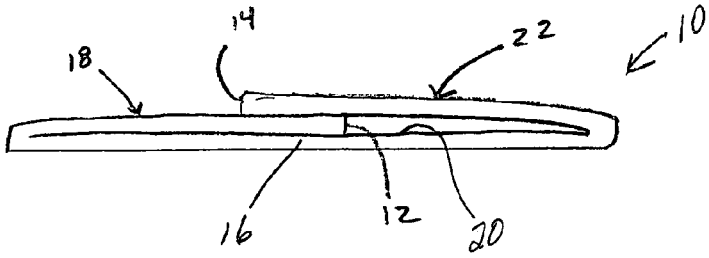
FIG. 4 is a cross-sectional view of the implement of FIG. 3 taken along line 4-4.

FIG. 4 is a cross-section view of the consumer usable, preformed, folded fibrous structure implement of FIG. 3.

Figure 5:
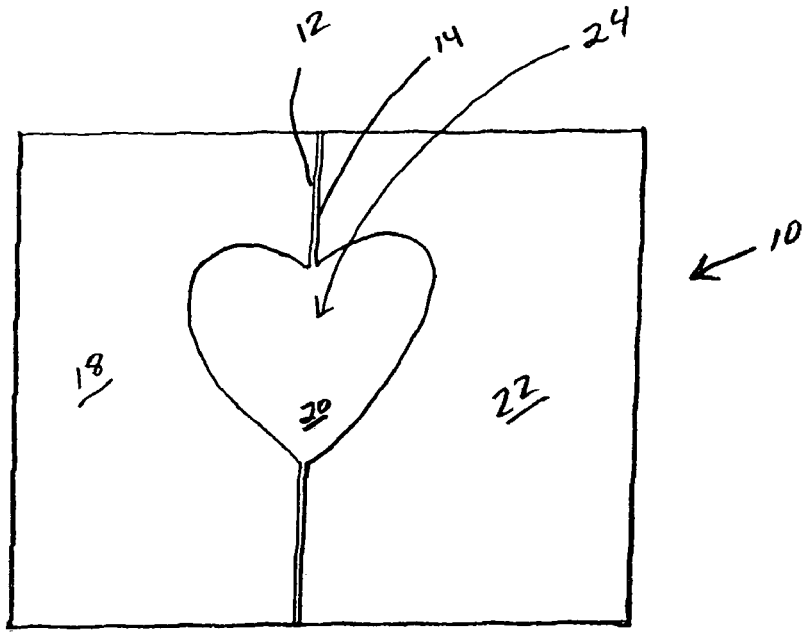
FIG. 5 is a planar view of another consumer usable, preformed, folded fibrous structure implement according to the present invention.

FIG. 5 illustrates a consumer usable, preformed, folded fibrous structure implement 10 wherein the first edge 12 and the second edge 14 combine to form a pattern.

Figure 6:
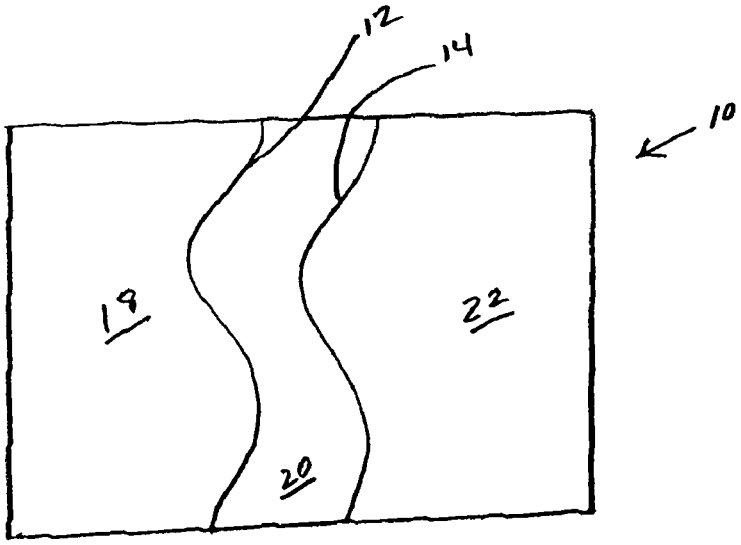
FIG. 6 is a planar view of another consumer usable, preformed, folded fibrous structure implement according to the present invention.

FIG. 6 illustrates a consumer usable, preformed, folded fibrous structure implement 10 wherein the first edge 12 is nonlinear and the second edge 14 is nonlinear. In one example, the first edge 12 may be linear and the second edge 14 may be nonlinear.

In another example, the first edge 12 may be nonlinear and the second edge 14 may be linear. In still another example, the first edge 12 may be linear and the second edge 14 may be linear.

Nonlimiting examples of nonlinear edges include sinusoidal edges, jagged edges, scalloped edges and dental edges.

Figure 7:
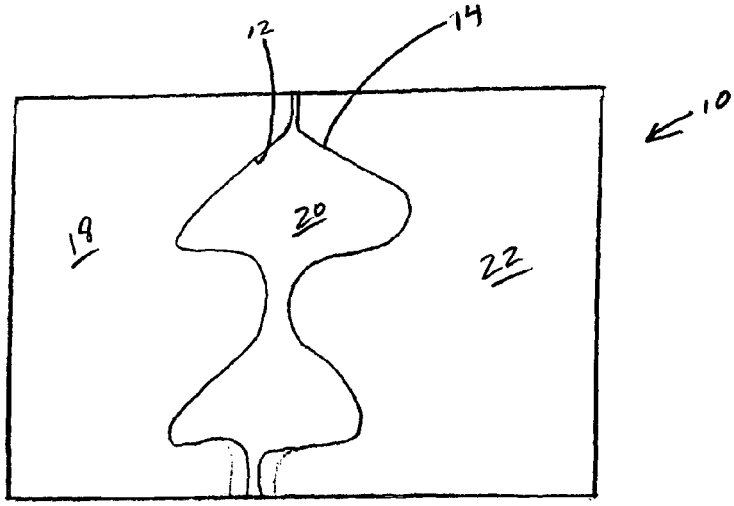
FIG. 7 is a planar view of another consumer usable, preformed, folded fibrous structure implement according to the present invention.

FIG. 7 illustrates another nonlimiting example of a consumer usable, preformed, folded fibrous structure implement 10 according to the present invention wherein the first and second edges are nonlinear and are complementary.

Figure 8:
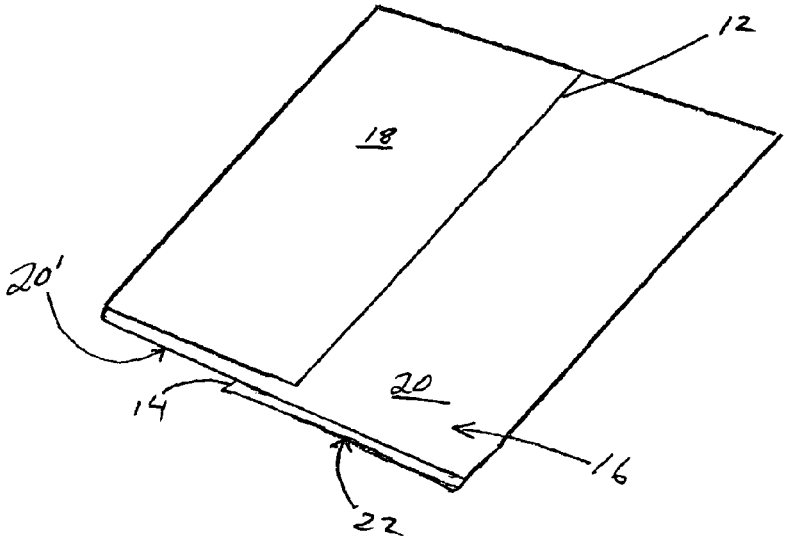
FIG. 8 is a perspective view of another consumer usable, preformed, folded fibrous structure implement according to the present invention.

FIG. 8 illustrates another example of a consumer usable, preformed, folded fibrous structure implement 10 according to the present invention wherein the first edge 12 overlies the first surface 20 of the body 16 and the second edge 14 overlies a second surface 20' of the body 16.

Figure 9:
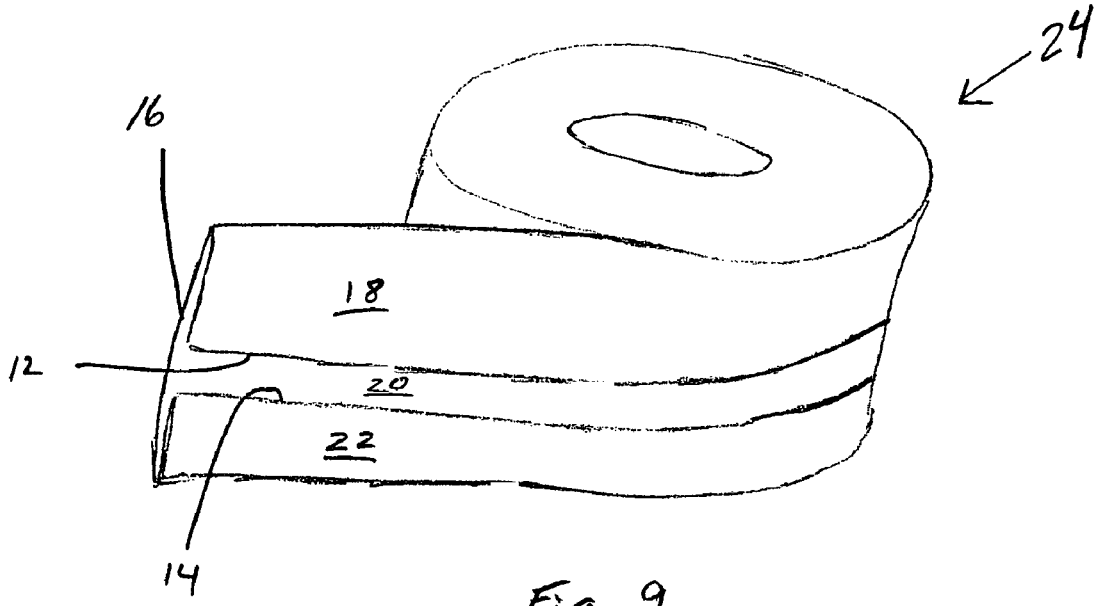
FIG. 9 is a perspective view of the consumer usable, preformed, folded fibrous structure implement of FIG. 1A in roll form.

As shown in FIG. 9, the consumer usable, preformed, folded fibrous structure implements 10 of the present invention may be convolutely wound to form a rolled product 24.

Exemplary Embodiments of Implement

The consumer usable, preformed, folded fibrous structure implement of the present invention may include visual and/or physical characteristics.

The implement of the present invention may include visual cues such as embossments, print, texture, and the like, that is phased on the implement in the machine direction and/or cross machine direction. For example, a visual cue may be phased such that the visual cue only is present on the first and/or second flaps and not on the body. In another example, the visual cue may be present on the body but not on one or both of the flaps. In yet another example, the visual cue may be present on first and/or second flaps and also on the body.

The implement of the present invention may include physical characteristics that differ (visually and/or quantitatively) between the first and second flaps and/or between the first and/or second flaps and the body. For example, the first and/or second flaps may have a caliper that is greater than and/or less than the caliper of the body. In another example, the first flap may have a caliper that is greater than or less than the caliper of the second flap. In yet another example, the first flap and the body may have calipers that are greater than the caliper of the second flap.

The implement of the present invention may include one surface that is not exposed to the user of the implement. For example, the wire side of the fibrous structure making up the implement may be configured to be on the "inside" of the implement and/or on the "outside" of the implement depending on the desired product. In addition, embossments may be configured to be present on the "inside" surface of the implement and/or on the "outside" surface of the implement depending on the desired product.

The implement of the present invention may comprise two or more plies of fibrous structures. In such multi-ply fibrous structure implements, one of the plies may be present on the "inside" of the implement. In other words, one of the plies may not be exposed to the user of the implement. In one example, at least one of the two or more plies in a multi-ply fibrous structure implement may have at least one property that is different from at least one other ply in the multi-ply fibrous structure implement. In another example, the multi-ply fibrous structure implement may comprise a ply of through-air-dried fibrous structure and a ply of conventional fibrous structure wherein the implement is configured such that the conventional fibrous structure is not exposed to a user of the implement.

The implement of the present invention may comprise a layered fibrous structure. For example, the layered fibrous structure may comprise a layer comprising one composition of pulp and a second layer comprising a different composition of pulp. The implement can be configured such that a portion of both of the pulp compositions are exposed to a user of the implement. For example the hardwood pulp layer may be exposed to a user of the implement with a smaller portion of the softwood pulp (such as in the body) being exposed to the user.

The fibrous structure used to form the implement of the present invention may exhibit a caliper, before folding, of at least 0.0254 cm (0.010 inches).

The implement of the present invention may comprise portions of the fibrous structure that have been treated with a chemical agent and/or portions of the fibrous structure that have been mechanically altered and/or portions of the fibrous structure that have received additional materials such as additional pulp fibers, and/or additional synthetic fibers and/or material. Such fibrous structures can be treated to deliver various functions (such as cleaning capability, softness, flexibility, absorbency, water resistance, etc.) from different portions of the implement of the present invention.

Fibrous Structure Additives

The fibrous structures of the present invention may comprise, in addition to fibers, an optional additive selected from the group consisting of permanent and/or temporary wet strength resins, dry strength resins, wetting agents, lint resisting agents, absorbency-enhancing agents, immobilizing agents, especially in combination with emollient lotion compositions, antiviral agents including organic acids, antibacterial agents, polyol polyesters, antimigration agents, polyhydroxy plasticizers, softening agents, lotions and mixtures thereof. Such optional additives may be added to the fiber furnish, the embryonic fibrous web and/or the fibrous structure.

Such optional additives may be present in the fibrous structures at any level based on the dry weight of the fibrous structure.

The optional additives may be present in the fibrous structures at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

Nonlimiting Example of Synthesis of Implement

The method of making a folded fibrous structure can be achieved by the following. A supply roll of fibrous material is unwound by driving the circumferential surface, end face surfaces, core, or any combination thereof. The unwinding speed is controlled to achieve a target web speed, relative speed to downstream operations, or web tension. The web is then embossed, if desired, by passing the web between two cooperating rolls, an example being a steel pattern roll loaded against a rubber covered roll, wherein at least one of the rolls imparts a texture or pattern into the web. The embossing means may be configured to emboss only cross machine portions of the web. The resulting longitudinal embossed portions of the web may be aligned in the cross machine with subsequent web transformations. After embossing, additional indicia such as ink may be applied to the web using flexographic, ink jet, or any other indicia imparting means known to one skilled in the art. Other web properties such as softness may also be modified by addition of performance enhancing materials to the web using spray systems, offset gravure systems, and other means known in the art. The web is then separated into at least two longitudinal web strips by linear or non-linear shear slitting, linear or non-linear score slitting, linear or non-linear die cutting, linear or non-linear water jet cutting, linear or non-linear laser cutting, or any other suitable means known in the art. The web strips are then folded using folding boards, turn bars, or any other devices known in the art, to create a "C" or "Z" fold configuration in which at least one portion of at least one web strip is deformed in the transverse direction to produce at least one flap which overlies the remaining portion of the web strip. Flaps which include non-linear edges may be oriented such that they form a complementary pattern once the edges are positioned in a proximate configuration. The folded web strips are then passed over a turn bar known to one of skill in the art and redirected to flow in a direction generally perpendicular to the original direction of web travel. Turn bars for each web strip may be positioned in different machine direction locations to reorient the web strips such that, after being redirected, they may be juxtaposed to one another for more efficient winding. Transverse zones of weakness may then be imparted to the folded web strips to enable easier dispensing by the user. Said embossing, indicia addition, slitting, folding, and imparting of transverse zones of weakness transformations may be phased to one another in the machine direction or the cross machine direction or both. The web strips are then rewound into a rolled product, either on a core or in a coreless configuration. The winding operation may control the rotational velocity of the core, the surface speed of the winding product's circumferential surface, or any combination thereof. The wound rolls are then transferred to other operations for wrapping, packing, and the like. Alternative transformation sequences and/or manufacturing methods known to one skilled in the art may also be used.

All documents cited in the Detailed Description of the Invention are, in relevant part, incorporated herein by reference; the citation of any document is not to be construed as an admission that it is prior art with respect to the present invention. Terms or phrases defined herein are controlling even if such terms or phrases are defined differently in the incorporated herein by reference documents.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A convolutely wound rolled sanitary tissue product comprising a consumer usable, preformed, folded fibrous structure implement capable of being dispensed from the rolled sanitary tissue product, wherein the consumer usable, preformed, folded fibrous structure implement comprises a first edge of the fibrous structure, a second edge of the fibrous structure and a body of the fibrous structure present between the first and second edges, wherein the first edge via a first flap of the fibrous structure present between the first edge and the body overlies a first surface of the body; wherein the second edge via a second flap of the fibrous structure present between the second edge and the body overlies the first flap such that the first flap is positioned between the body of the fibrous structure and the second flap.

2. The rolled sanitary tissue product according to claim 1 wherein the rolled sanitary tissue product comprises a plurality of the consumer usable, preformed, folded fibrous structure implements.

3. The rolled sanitary tissue product according to claim 1 wherein the second flap overlies less than 100% of the surface area of the first flap.

4. The rolled sanitary tissue product according to claim 1 wherein the first edge is non-linear.

5. The rolled sanitary tissue product according to claim 1 wherein the second edge is non-linear.

6. The rolled sanitary tissue product according to claim 1 wherein the first edge and second edge are complementary.

7. The rolled product according to claim 1 wherein the body of the fibrous structure comprises a first ingredient and the first flap of the fibrous structure comprises a second ingredient different from the first.

8. The rolled product according to claim 1 wherein the body of the first structure exhibits a first fibrous structure property value and the first flap of the fibrous structure exhibits a second fibrous structure property value different from the first fibrous structure property value.

9. The rolled product according to claim 1 wherein the body of the first structure exhibits a first fibrous structure property and the first flap of the fibrous structure exhibits a second fibrous structure property different from the first fibrous structure property value.

10. The rolled product according to claim 1 wherein the body of the fibrous structure comprises a design element different from the first flap.

11. The rolled product according to claim 1 wherein the fibrous structure comprises embossments.

12. The rolled product according to claim 11 wherein the embossments are present on the first flap.

13. The rolled product according to claim 11 wherein the embossments are present on the body.

14. The rolled product according to claim 11 wherein the embossments are present on the first flap and on the body, wherein the embossments on the first flap create a pattern that is different than the embossments on the body.

15. The rolled product according to claim 11 wherein the embossments are present on a second flap of the fibrous structure formed by overlying the second edge on the first surface of the body.

16. The rolled product according to claim 11 wherein the embossments are present on at least two regions of the fibrous structure comprising the first flap, the second flap and/or the body and wherein the embossments create different patterns on the at least two regions of the fibrous structure.

17. The rolled product according to claim 1 wherein the fibrous structure comprises printing.

18. The rolled product according to claim 1 wherein the at least one of the consumer usable, preformed, folded fibrous structure implements exhibits a cross machine direction caliper that varies in value along it cross machine direction.

19. The rolled product according to claim 18 wherein the at least one of the consumer usable, preformed, folded fibrous structure implements exhibits a cross machine direction caliper that varies in value by less than 2 times the caliper of the least caliper.

20. The rolled product according to claim 1 wherein the body further comprises a first surface and wherein the first flap and second flaps contact the first surface of the body.

* * * * *